US007597367B2

(12) United States Patent
Berenfield et al.

(10) Patent No.: US 7,597,367 B2
(45) Date of Patent: Oct. 6, 2009

(54) CLOSURE RING ASSEMBLY FOR STEEL DRUMS

(75) Inventors: Gregory N. Berenfield, Chapel Hill, NC (US); Titus Techera, Mason, OH (US)

(73) Assignee: Berenfield Holdings (Mason), LLC, Mason, OH (US)

( * ) Notice: Subject to any disclaimer, the term of this patent is extended or adjusted under 35 U.S.C. 154(b) by 0 days.

(21) Appl. No.: 11/421,498

(22) Filed: Jun. 1, 2006

(65) Prior Publication Data

US 2006/0255598 A1 Nov. 16, 2006

Related U.S. Application Data

(63) Continuation-in-part of application No. 11/130,299, filed on May 16, 2005, now abandoned.

(51) Int. Cl.
*B65D 45/30* (2006.01)

(52) U.S. Cl. ..... 292/256.67; 292/256.6; 292/256.65

(58) Field of Classification Search ..... 292/256.67, 292/256.71, 256.73, 256; 220/320
See application file for complete search history.

(56) References Cited

U.S. PATENT DOCUMENTS 0,407,559 A 7/1889 Wells
1,005,227 A 10/1911 Jones
2,159,862 A * 5/1939 Schaefer et al. ..... 292/256.67
2,194,162 A * 3/1940 Conner ..... 292/256.69
2,377,891 A 6/1945 Laue
2,439,161 A * 4/1948 Du Bois ..... 248/672
2,486,565 A 11/1949 Kojan et al.
2,625,721 A 1/1953 Lockhart
2,915,330 A * 12/1959 Verbiar ..... 292/256.67
3,907,349 A 9/1975 Kane
4,134,609 A 1/1979 Santoni
4,550,935 A 11/1985 Marshall et al.
4,611,839 A 9/1986 Rung et al.
4,982,864 A * 1/1991 Kusta ..... 220/320
5,026,360 A * 6/1991 Johnsen et al. ..... 604/338
5,193,864 A * 3/1993 Coleman ..... 292/256.67
5,215,206 A 6/1993 Siblik
5,584,410 A * 12/1996 Siblik ..... 220/320
5,851,038 A 12/1998 Robinson et al.
6,435,576 B1 * 8/2002 Kusta ..... 292/256.67
6,454,316 B1 * 9/2002 Aaron, III ..... 285/379

* cited by examiner

*Primary Examiner*—Carlos Lugo
*Assistant Examiner*—Kristina R Fulton
(74) *Attorney, Agent, or Firm*—Thompson Hine LLP

(57) ABSTRACT

Interlocking end lugs are provided in an improved closure split ring assembly for steel drums. The interlocking end lugs facilitate the tangential alignment of the ring to seal the lid on the drum and lock it in place.

14 Claims, 2 Drawing Sheets

CLOSURE RING ASSEMBLY FOR STEEL DRUMS

RELATED APPLICATION

This application is a continuation-in-part application of U.S. patent application Ser. No. 11/130,299, filed May 16, 2005, entitled "Closure Ring Assembly for Steel Drums" and the entire disclosure of that application is incorporated herein by reference.

FIELD OF THE INVENTION

This invention is directed to closure assemblies for steel drums that are used for transporting non-bulk materials. In particular, this invention is directed to an improved closure ring assembly capable of ensuring that the drum remains secure and leakproof during transit.

BACKGROUND OF THE INVENTION

Conventional closure ring assemblies for drums include a split closure ring having adjacent ends with lugs on each end. One of the lugs has an unthreaded hole and the other lug has a threaded hole for receiving a conventional bolt. When the lid of the drum is secured to its opening, the closure ring is placed around the lid and the bolt is inserted through the unthreaded hole of one of the lugs to engage the threaded hole of the other lug. As the threaded bolt engages the threaded hole, the ends of the closure ring are drawn together to tighten the closure ring around the lid and the drum.

Organizations have developed packaging standards that require compliance with certain vibration, drop and hydrostatic tests to ensure that the drums remain secure and leakproof during transit. Typically, because of the excessive radial clearance between the tie bolt and the enlarged opening of the unthreaded lug, the ends of the closed split ring are prone to separation and movement under impact. This causes ring distortion and seal failure eventually leading to leakage, container failure and possible contamination of both the storage container and its surroundings.

A number of closure ring assemblies have been proposed to overcome the common problems associated with their designs. For instance, in the case of U.S. Pat. No. 5,584,410, a threaded jam nut is mounted on the bolt between the two lugs to prevent unwanted radial movement between the unthreaded lug and the bolt when the split ring is closed. The jam nut is included in the assembly to secure the unthreaded lug between the bolt head and the jam nut to aid in withstanding impact forces. Other designs have been provided to achieve a seal for the open-headed drum that prevents against leakage of the contents, such as those disclosed in U.S. Pats. Nos. 3,907,349; 5,193,864; 5,215,206 and 6,435,576. In the case of the '864 patent, the common problem of undesired movement of the bolt in the unthreaded hole of the lug which can disrupt the sealed relationship between the lid and the drum is addressed by employing a bolt head which is tapered to cooperate with the tapered, unthreaded lug. When the bolt head is drawn into engagement with the unthreaded lug, it causes a guided wedging action and a tangential alignment movement between the lugs and ring ends, with locking nuts adjusted to set the bolt for the desired tension of the locking ring. In the case of the '576 patent, the problem of undesired radial and axial movement of the closure ring is addressed by designing a bolt with a slip sleeve which is flush with the periphery of a large unthreaded hole. The sleeve thereby reduces the movement that is allowable within the large threaded hole to secure the connection of the bolt to the lugs and reinforce the closure ring connection to the drum.

While the designs of existing patents have sought to address and overcome the common problem discussed above, there still remain difficulties with the conventional closure ring assemblies in achieving a tight connection between the closure ring and the drum, thereby complying with vibration, drop and hydrostatic test standards.

Notwithstanding the efforts to achieve tighter connections between the closure ring and the drum with the prior designs described above, a continuing need exists to provide a more secure connection.

SUMMARY OF THE INVENTION

This invention is directed to an improved closure ring assembly for steel drums which includes interlocking end lugs for the split ring. The interlocking end lugs facilitate the tangential alignment of the ring to seal the lid on the drum and lock it in place.

The improved closure ring assembly for securing a lid to a cylindrical drum comprises an annular closure split ring having first and second end lugs. The first end lug has an unthreaded hole and the second threaded lug has a threaded hole. A tie bolt having a head and a threaded cylindrical end is adapted for insertion through the first unthreaded lug to threadingly engage the second threaded lug and draw the lugs together. The first and second lugs each have an end face for interlocking the lugs and tangentially aligning the annular closure ring to close the ring for sealing the lid on the drum.

In a preferred form of the invention, the first end lug face has a conical shoulder integrally formed therein and the second threaded lug is tapered to receive the conical shoulder such that, when the tie bolt threadingly draws the lugs into successive engagement, there is provided a guided wedging action between the lugs and tangential alignment of the ring ends to seal the drum.

In another form of the invention, each of the end faces of the first and second lugs may be modified for interlocking the lugs and tangentially aligning the annular closure ring for sealing the lid on the drum. In this form of the invention, the end faces are flat or plane for engagement of one another such that, when the tie bolt threadingly draws the lugs into successive engagement, the end faces abut one another thereby interlocking the lugs together and tangentially aligning the annular closure ring to close the ring for sealing the lid on the drum. The tie bolt which is used to threadingly draw the lugs into successive engagement may be in the form described above with a tapered shoulder for cooperating with the tapered face of the first unthreaded lug. In another form, the tie bolt has a cylindrical shoulder which cooperates With the hole of the first unthreaded lug such that it is flush with the hole and assists in facilitating the successive engagement of the lugs to provide the tangential alignment of the ring ends to seal the drum. Other alternative embodiments of the lug faces can be arranged. For instance, outwardly projecting teeth of the end faces can be provided to further facilitate locking engagement of the lugs. Similarly, both sides of the lugs can have outwardly projecting teeth such that the head of the tie bolt or nut can engage the projecting teeth of the adjacent lug to frictionally engage the lug and assist in locking the end lugs together.

In its most preferred form, the bolt head has a tapered shoulder for cooperating with a tapered face of the first unthreaded lug such that, when the tie bolt draws the lugs into engagement, the tapered bolt head and cooperating unthreaded lug facilitate the successive engagement of the lugs to provide the guided wedging action between the lugs and tangential alignment of the ring ends to seal the drum.

In contrast to the prior designs, the closure ring assembly of the present invention provides for closure ring lugs which interlock and align the ring ends resulting in a tighter connection between the closure ring ends and the drum. Moreover, the closure ring assembly of the present invention satisfies the need for a reliable closure ring assembly which meets hydrostatic and drop test requirements.

Accordingly, the present invention satisfies a need to provide an improved closure ring assembly for a cylindrical steel drum that will meet current industry standards. The invention also meets another objective of providing an improved closure ring assembly for drums that overcomes the problem of undesired radial and axial movement of the closure ring.

These and other objectives and advantages of the present invention will become more apparent from the following detailed description.

BRIEF DESCRIPTION OF THE DRAWINGS

An annular closure ring assembly embodying the principles of the present invention is shown in the accompanying drawings wherein.

DETAILED DESCRIPTION OF THE PREFERRED EMBODIMENT

Figure 1:
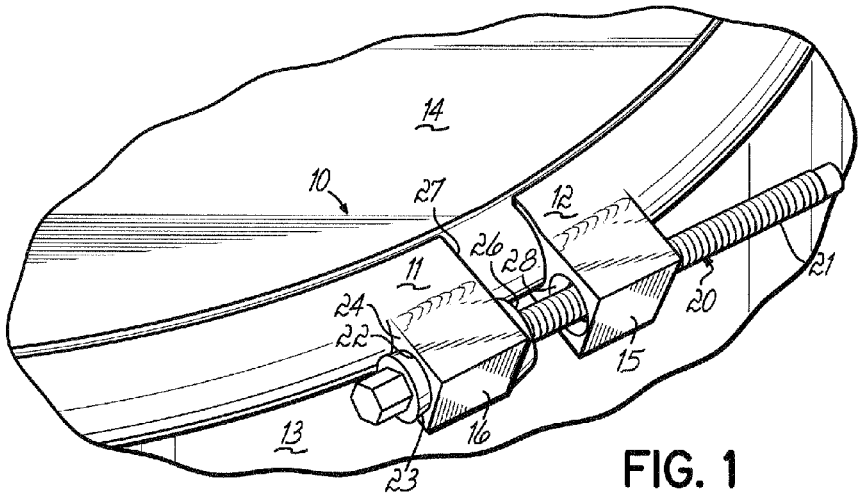
FIG. 1 is a partial exploded perspective view of the drum, drum cover and closure assembly embodying the present invention.
Figure 2:
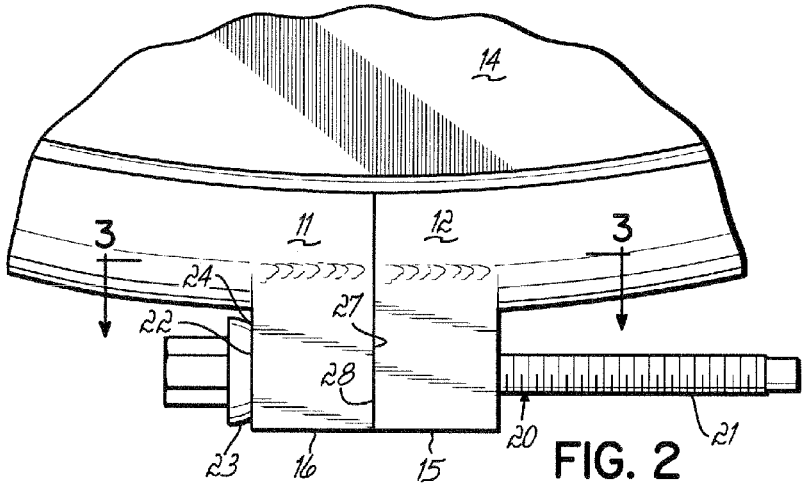
FIG. 2 is a top plan view of the closure assembly shown in FIG. 1 which illustrates the condition of the parts when the closure assembly is in closed condition.
Figure 3:
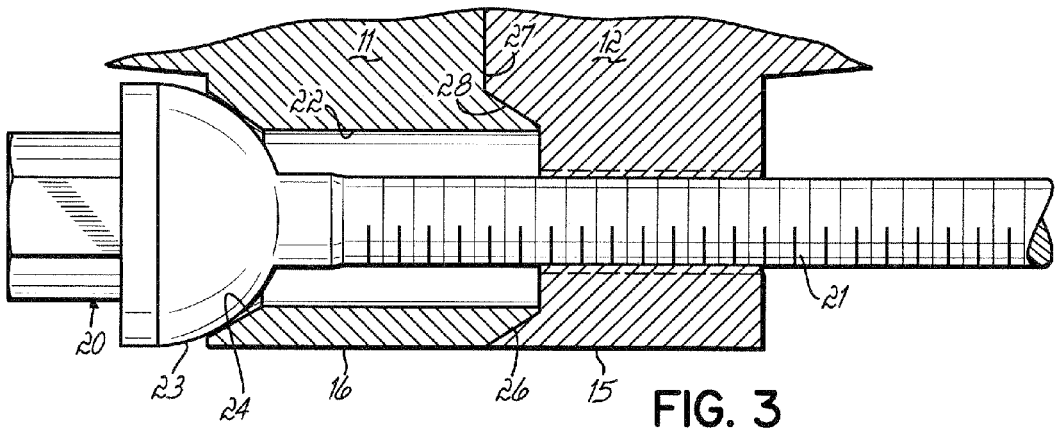
FIG. 3 is a cross sectional view taken substantially along the line 3-3 of FIG. 2 looking in the direction of the arrows.

With reference to FIGS. 1-3 of the drawings, the drum ring of this invention is split to provide two adjacent ends 11, 12 that are capable of surrounding an open-headed drum 13 and secure the lid 14.

At the ring ends are lugs 15, 16, each having a hole passing tranversely therethrough to receive a tie bolt 20. One of the lugs 15 is threaded to receive the threaded end 21 of the tie bolt 20 and the other lug 16 has an unthreaded hole 22 which is large enough for the tie bolt 20 to pass through it. A tapered conical shoulder 23 is integrally formed onto the bolt 20 head which is designed to be substantially flush with the tapered face 24 of lug 16. The unthreaded lug 16 has a conical shoulder 26 integrally formed on its opposite face 27 which is designed to be flush with a taper in the face 28 of the second threaded lug 15. Accordingly, when the unthreaded lug 16 is drawn into engagement with the threaded lug 15 by turning the bolt 20 head, the bolt head shoulder 23 engages the tapered face 24 of the unthreaded lug 16 to provide a guided wedging action between conical shoulder 26 and the tapered face 28 of the threaded lug 15. As a result, the ring ends 11, 12 are brought into tangential alignment and, as the bolt 20 is rotated to drive the lugs 15, 16 toward one another, the lugs are brought into frictional and locking engagement to close the ring for sealing the drum lid.

In the most preferred form, the tie bolt 20 head is multifaceted to facilitate turning the tie bolt down with a wrench and the tie bolt also has a conical surface 23 which engages the conical face 24 of the unthreaded lug end 16. In this most preferred form, the opposite face of the unthreaded lug 16 also has a conical shoulder 26 which fits into the recessed conical face 28 of the second threaded lug 15. With this most preferred arrangement, when the tie bolt 20 is rotated to draw the lugs 15, 16 toward one another, the lugs are brought into frictional and locking engagement to tangentially close the ring for sealing the drum. In contrast to the prior art as represented by the above patents in the background, which are focused on the various features of the lug and bolt arrangements such as headed bolts, sleeves, locking nuts, etc., there has been no disclosure or suggestion in the prior art of an interlocking lug arrangement as provided by this invention. Furthermore, there has been no disclosure or suggestion of the preferred embodiments of this invention which facilitate the sealing of an open-headed drum.

Figure 4:
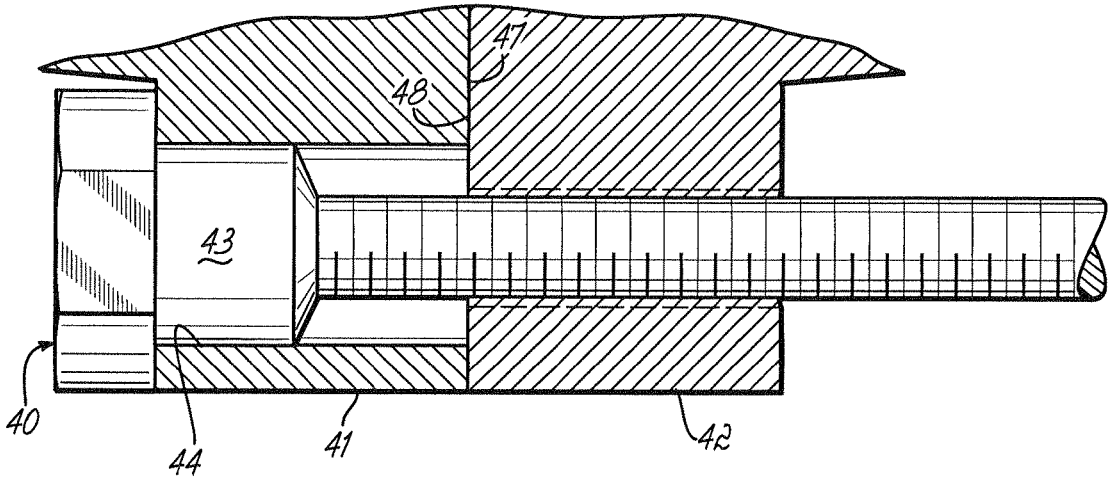
FIG. 4 is a cross sectional view of another embodiment of the invention with the end faces of the lugs modified to provide flat or plane surfaces for interlocking the lugs and tangentially aligning the annular closure ring. In this embodiment, a different tie bolt is shown having a cylindrical shoulder for cooperating with the hole of the first unthreaded lug.
Figure 5:
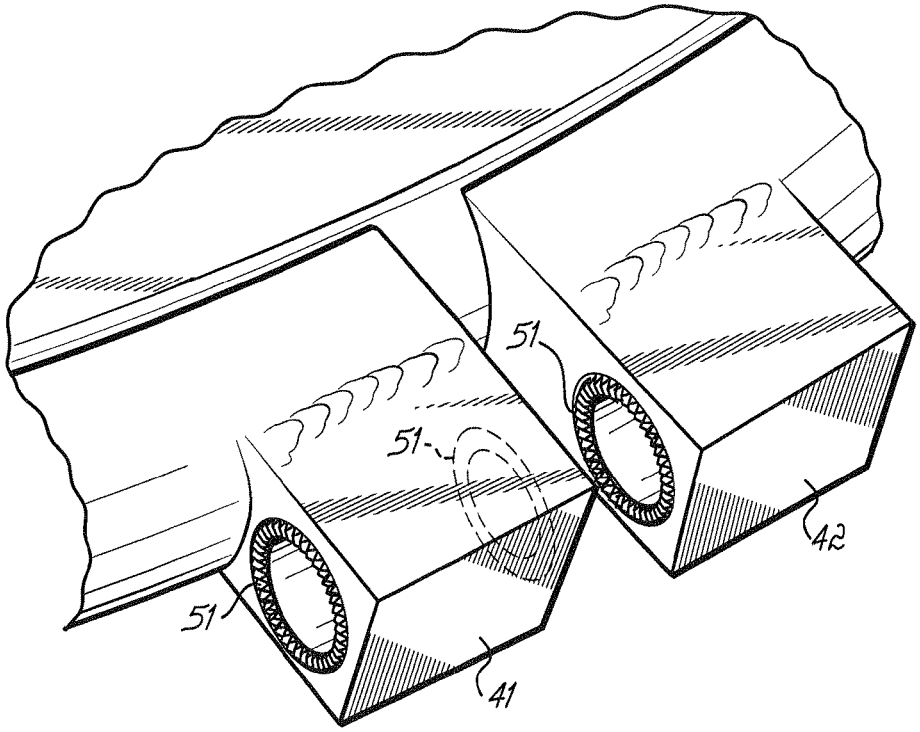
FIG. 5 is a partial perspective view of an end lug illustrating the outwardly projecting teeth bordering the lug opening for locking engagement of the underside of the tie bolt thereby enhancing interlocking of the lugs.

With reference to FIGS. 4 and 5, In another form of the invention, each of the end faces of the first and second lugs 41,42 may be modified for interlocking the lugs and tangentially aligning the annular closure ring for sealing the lid on the drum. In this form of the invention, the end faces 47,48 are flat or plane for engagement of one another such that when the tie bolt 40 threadingly draws the lugs 41,42 into successive engagement, the end faces 47,48 abut one another thereby interlocking the lugs together and tangentially aligning the annular closure ring to close the ring for sealing the lid on the drum. The tie bolt 40 which is used to threadingly draw the lugs 41,42 into successive engagement may be modified to have a cylindrical shoulder 43 which cooperates with the hole 44 of the first unthreaded lug 41 such that it is flush with the hole and assists in facilitating the successive engagement of the lugs 41,42 to provide the tangential alignment of the ring ends to seal the drum. Other alternative embodiments of the lug faces can be arranged. For instance, with reference to FIG. 5, outwardly projecting teeth 51 of the end face of a lug further facilitate locking engagement of the lugs. Similarly, as shown in phantom lines, both sides of the lugs can have outwardly projecting teeth 51 such that the head of the tie bolt engages the projecting teeth 51 to frictionally engage the lug and assist in locking the end lugs together.

Other forms of this invention will become apparent in view of the description and preferred embodiments which are not intended to limit its scope.

What is claimed is:

1. A closure ring assembly securing a lid to a cylindrical drum, comprising:

an annular closure split ring having a first unitary end lug and a second unitary end lug, the first unitary end lug having an unthreaded hole extending therethrough to an end face of the first unitary end lug, the second unitary end lug having a threaded hole extending therethrough to an end face of the second unitary end lug, the end face of the first unitary end lug including a portion surrounding the unthreaded hole and the end face of the second unitary end lug including a portion surrounding the threaded hole, a tie bolt having a head and a threaded portion inserted through the unthreaded hole of the first unitary end lug and engaged with the threaded hole of the second unitary end lug to hold the first and second unitary end lugs together, the end face of the first unitary end lug directly abutting the end face of the second unitary end lug and interlocking the first and second unitary end lugs together by frictionally abutting the end faces into locking engagement and tangentially aligning the annular closure ring to close the ring sealing the lid on the drum, the surrounding portion of the end face of the first unitary end lug engaged with the surrounding portion of the end face of the second unitary end lug such that a lengthwise portion of the tie bolt is enclosed and contained within the abutting first and second unitary end lugs and the end faces abut at the location where the threaded hole and the unthreaded hole are located.

2. The assembly of claim 1 wherein the surrounding portion of the end face of the first unitary end lug has a conical shoulder integrally formed therein and the surrounding portion of the end face of the second unitary end lug is inwardly tapered, the conical shoulder wedged within the tapered surrounding portion of the second unitary end lug.

3. The assembly of claim 1 wherein the bolt head has a tapered shoulder cooperating with a tapered face of the first unitary end lug opposite its end face such that when the tie bolt draws the first and second unitary end lugs together the tapered bolt head and cooperating tapered face provide a guided wedging action.

4. The assembly of claim 3 wherein the tapered shoulder is conically shaped.

5. The assembly of claim 4 wherein the tapered face is conically shaped.

6. The assembly of claim 1 wherein the end face of the first unitary end lug is plane and the end face of the second unitary end lug is plane.

7. The assembly of claim 1 wherein the bolt head has a cylindrical shoulder cooperating with the unthreaded hole of the first unitary end lug to facilitate the engagement of the first and second unitary end lugs.

8. The assembly of claim 1 wherein a face of the first unitary end lug opposite its end face has projecting teeth for cooperating with the bolt head to assist in interlocking the first and second unitary end lugs.

9. The assembly of claim 1 wherein at least one of the end face of the first unitary end lug or the end face of the second unitary end lug has projecting teeth to assist in interlocking the first and second unitary end lugs.

10. A closure ring assembly securing a lid to a cylindrical drum, comprising:

an annular closure split ring including a drum engaging ring portion having a first end and a second end, a first unitary end lug positioned at the first end and a second unitary end lug positioned at the second end, the first unitary end lug having a hole extending therethrough to an end face of the first unitary end lug, the second unitary end lug having a threaded hole extending therethrough to an end face of the second unitary end lug, the end face of the first unitary end lug aligned with the first end of the ring portion, the end face of the second unitary end lug aligned with the second end of the ring portion, a tie bolt through the hole of the first unitary end lug and threadingly engaged with the threaded hole of the second unitary end lug to hold the first and second unitary end lugs together, the end face of the first unitary end lug directly abutting the end face of the second unitary end lug at the location where the hole and threaded hole are located and interlocking the unitary end lugs together by frictionally abutting the end faces into locking engagement and sealing the lid on the drum.

11. The assembly of claim 10 wherein the end face of the first unitary end lug is plane and the end face of the second unitary end lug is plane.

12. The assembly of claim 10 wherein the tie bolt has a head with a cylindrical shoulder cooperating with the hole of the first unitary end lug to facilitate engagement of the first and second unitary end lugs.

13. The assembly of claim 10 wherein a face of the first unitary end lug opposite its end face has projecting teeth cooperating with a head of the tie bolt to assist in interlocking the first and second unitary end lugs.

14. The assembly of claim 10 wherein at least one of the end face of the first unitary end lug or the end face of the second unitary end lug has projecting teeth to assist in interlocking the first and second unitary end lugs.

* * * * *